US009492867B2

(12) United States Patent
Murasugi et al.

(10) Patent No.: US 9,492,867 B2
(45) **Date of Patent: *Nov. 15, 2016**

(54) FORMING DIE ASSEMBLY FOR MICROCOMPONENTS

(75) Inventors: Narutoshi Murasugi, Matsudo (JP); Kazunori Maekawa, Matsudo (JP); Zenzo Ishijima, Matsudo (JP)

(73) Assignee: HITACHI POWDERED METALS CO., LTD., Chiba (JP)

( * ) Notice: Subject to any disclaimer, the term of this patent is extended or adjusted under 35 U.S.C. 154(b) by 757 days.

This patent is subject to a terminal disclaimer.

(21) Appl. No.: 13/279,759

(22) Filed: Oct. 24, 2011

(65) Prior Publication Data

US 2012/0107434 A1 May 3, 2012

(30) Foreign Application Priority Data

Oct. 29, 2010 (JP) ..... 2010-243218

(51) Int. Cl.

| | |
|---|---|
| ***B22F 3/00*** | (2006.01) |
| ***B22F 3/03*** | (2006.01) |
| ***B30B 15/30*** | (2006.01) |
| *B30B 11/02* | (2006.01) |

(52) U.S. Cl.

CPC ..... *B22F 3/03* (2013.01); *B30B 15/302* (2013.01); *B30B 11/02* (2013.01)

(58) Field of Classification Search

CPC ..... B22F 3/03; B30B 11/02; B30B 15/302

USPC ..... 425/78

See application file for complete search history.

(56) References Cited

U.S. PATENT DOCUMENTS

| | | | | |
|---|---|---|---|---|
| 2,362,701 | A * | 11/1944 | Koehring | B22F 3/12 100/218 |
| 2,810,929 | A * | 10/1957 | Willi | B30B 11/02 425/354 |
| 3,020,589 | A * | 2/1962 | Maritano | B22F 3/02 425/354 |
| 3,524,220 | A * | 8/1970 | Davison | B30B 11/04 425/195 |
| 5,897,826 | A * | 4/1999 | Lashmore | B22F 3/004 264/109 |
| 6,440,357 | B1 * | 8/2002 | Hinzmann | B21K 1/30 419/66 |

(Continued)

FOREIGN PATENT DOCUMENTS

| | | |
|---|---|---|
| DE | 102007040502 B4 | 6/2012 |
| JP | U-02-111502 | 9/1990 |

(Continued)

OTHER PUBLICATIONS

Apr. 24, 2014 Office Action issued in Japanese Patent Application No. 2010-243218 (with English translation).

(Continued)

*Primary Examiner* — Robert J Grun
(74) *Attorney, Agent, or Firm* — Oliff PLC

(57) ABSTRACT

A forming die assembly for microcomponents includes a forming die and a punch. The forming die is formed with a cavity, a punch hole connected to the cavity, and a supply path for supplying a raw material with a metal powder and a binder having plasticity. The supply path is connected to the cavity so as to have a gate therebetween and is used for supplying the raw material into the cavity. The punch is slidably inserted into the punch hole, and it opens and closes the gate by reciprocatory sliding. The punch closes the gate and compresses the raw material in the cavity into a green compact by sliding in the direction of the cavity.

2 Claims, 4 Drawing Sheets

(56) References Cited

U.S. PATENT DOCUMENTS

| | | | | |
|---|---|---|---|---|
| 2006/0257279 | A1 | 11/2006 | Ishijima et al. | |
| 2009/0108970 | A1* | 4/2009 | Oi et al. | 335/302 |
| 2012/0107444 | A1* | 5/2012 | Murasugi et al. | 425/551 |
| 2012/0107445 | A1* | 5/2012 | Murasugi et al. | 425/551 |
| 2012/0214014 | A1* | 8/2012 | Schmitt et al. | 428/553 |
| 2012/0216654 | A1* | 8/2012 | Schmitt et al. | 75/228 |

FOREIGN PATENT DOCUMENTS

| | | | |
|---|---|---|---|
| JP | A-04-200998 | | 7/1992 |
| JP | A-2001-334399 | | 12/2001 |
| JP | A-2006-344581 | | 12/2006 |
| JP | A-2011-088411 | | 5/2011 |
| JP | A-2011-089192 | | 5/2011 |
| WO | WO2011/035862 | * | 3/2011 |

OTHER PUBLICATIONS

Sep. 11, 2015 Office Action issued in German Application No. 10 2011 117 316.5.

* cited by examiner 10
20
21
22
23
24
25
P
26
27
30
31
32
33
34
40
1A
3
4
5
6

FORMING DIE ASSEMBLY FOR MICROCOMPONENTS

BACKGROUND OF THE INVENTION

Technical Field

The present invention relates to a forming die assembly including dies that may be used for producing microcomponents such as microgears. In the dies, a raw material with a metal powder and a binder having plasticity is compacted into a green compact with a shape similar to that of the microcomponent.

Background Art

Recently, in the production of digital home appliances, advanced medical equipment, and IT devices, there are trends toward decreasing dimensions and increasing performances of the devices. Therefore, requirements for decreasing dimensions and wall thicknesses have been increasing for components of such devices. In view of this, although microcomponents basically have small dimensions and thin walls, the microcomponents are also required to be even smaller and have thinner walls. A production method for such microcomponents is disclosed in Japanese Patent Application of Laid-Open No. 2006-344581. In this method, a raw material with a metal powder and a binder having plasticity is filled in a die and is compressed by a punch, whereby a green compact with a shape similar to that of the target shape is formed. Then, the green compact is sintered.

According to the production method of the green compact disclosed in Japanese Patent Application of Laid-Open No. 2006-344581, the raw material is sufficiently filled at a portion of the die, which corresponds to a thin-walled portion of the target shape. Therefore, a green compact with high accuracy is obtained. In this case, since the raw material is different from a raw powder, which is used in an ordinary powder metallurgy process, and has plasticity, the raw material is difficult to use. That is, a predetermined amount of the raw material must be directly filled in the die, and this increases the steps in the process. The raw material is filled in the die at each compacting as is the case in an ordinary die forming for compacting a powder. However, in a case of forming a microcomponent, since the amount of raw material required for one compacting is extremely small, this production method is not efficient.

SUMMARY OF THE INVENTION

The present invention has been completed in view of the above circumstances, and an object of the present invention is to provide a forming die assembly for microcomponents. According to the forming die assembly, a raw material with a metal powder and a binder having plasticity (hereinafter called a "raw material") is easily supplied to dies and is thereby efficiently compacted, whereby a green compact is obtained.

The present invention provides a forming die assembly for microcomponents, and the forming die assembly includes a forming die and a punch. The forming die is formed with a cavity, a punch hole connected to the cavity, and a supply path. The supply path is connected to the cavity so as to have a gate therebetween and is used for supplying a raw material having plasticity into the cavity. The punch is slidably inserted into the punch hole, and it opens and closes the gate by reciprocatory sliding. The punch closes the gate and compresses the raw material in the cavity into a green compact by sliding in the direction of the cavity.

According to the present invention, the raw material is supplied through the supply path into the cavity of the forming die, and the raw material in the cavity is compacted into a green compact by the punch. Then, the forming die assembly is opened, whereby the green compact is obtained. By repeating the above operation, green compacts are continuously obtained. The raw material in a small amount is easily successively filled in the cavity by supplying the raw material through the supply path. Moreover, it is not required to pull out the punch for the supply of the raw material. Accordingly, the green compacts are efficiently produced.

In the present invention, the forming die may be provided with a storage portion which is connected to the supply path and is used for storing the raw material. In addition, the storage portion may be formed so that a plunger is slidably inserted thereinto, and the plunger may supply the raw material stored in the storage portion via the gate into the cavity. In this case, since the forming die has the storage portion for supplying the raw material to the supply path, it is not required to arrange a storage portion separately and to connect the storage portion to the supply path. Therefore, the forming die assembly of the present invention can be independently operated, and the supply route of the raw material is simple.

In the present invention, the forming die may be provided with an upper die and a lower die which are arranged so that they can relatively vertically make contact with each other and separate from each other. The punch hole and the supply path may be formed at one of the upper die and the lower die. The cavity may be formed when the upper die and the lower die are brought into contact with each other.

In the present invention, the green compact may have a flange portion and a shaft portion, and the shaft portion may project from the flange portion.

Moreover, in the present invention, in order to improve the flowability of the raw material and to easily fill the raw material into the cavity, the forming die is preferably provided with a heating means for heating the raw material that passes through the supply path.

According to the present invention, a forming die assembly for microcomponents is provided, and the raw material is easily supplied to the forming die, and thereby a green compact is efficiently obtained.

PREFERRED EMBODIMENTS OF THE INVENTION

Embodiments of the present invention will be described with reference to the figures hereinafter.

(1) Microgear

Figure 1:
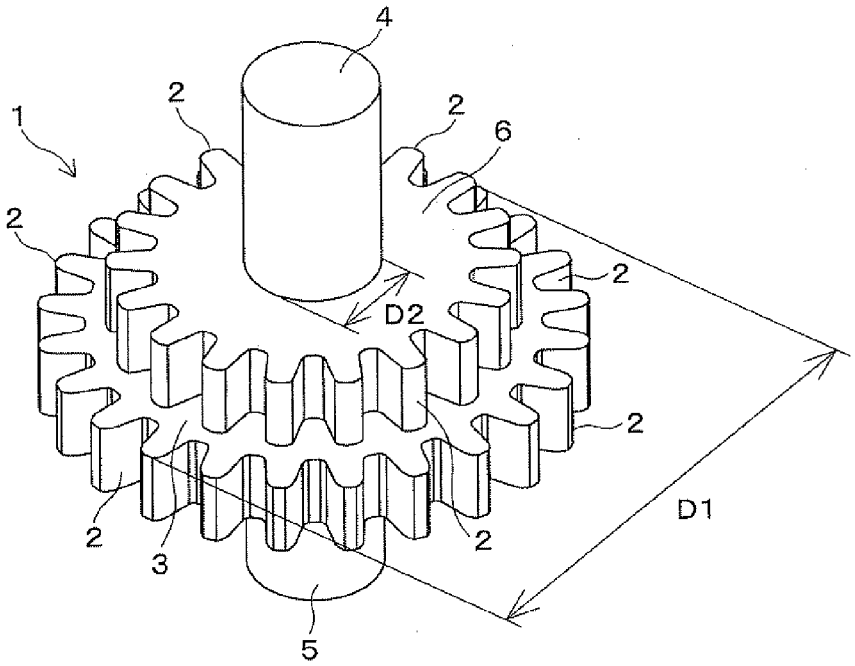
FIG. 1 is a perspective view showing a microgear obtained from a green compact that is formed by a forming die assembly of an embodiment of the present invention.

FIG. 1 shows a microgear of a microcomponent. The gear 1 is obtained by sintering a green compact that is formed by a forming die assembly of an embodiment. The gear 1 is a two-step gear in which a spur wheel portion 6 is formed on a side (upper side in FIG. 1) of a spur wheel portion 3. The spur wheel portion 6 has a smaller diameter, and the spur wheel portion 3 has a larger diameter. The gear 1 has shaft portions 4 and 5. The shaft portion 4 projects from the spur wheel portion 6. The shaft portion 5 projects from the spur wheel portion 3 and has the same diameter as that of the shaft portion 4. Each of the spur wheel portions 3 and 6 is formed with plural teeth 2 at the outer circumferential surface thereof. The gear 1 may have the following dimensions. For example, the spur wheel portion 3 has an outer diameter D1 of several hundred micrometers to several millimeters, and the shaft portions 4 and 5 have a diameter D2 of several dozen to several hundred micrometers.

(2) Forming Die Assembly (2-1) Structure

Figure 2A:
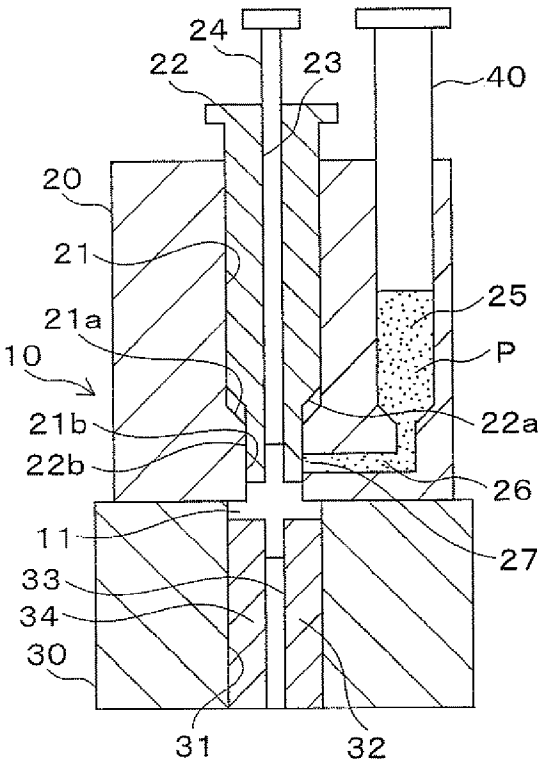
FIGS. 2A to 2C are cross sectional views showing an early part of a forming step of a green compact using the forming die assembly of an embodiment.
Figure 2B:
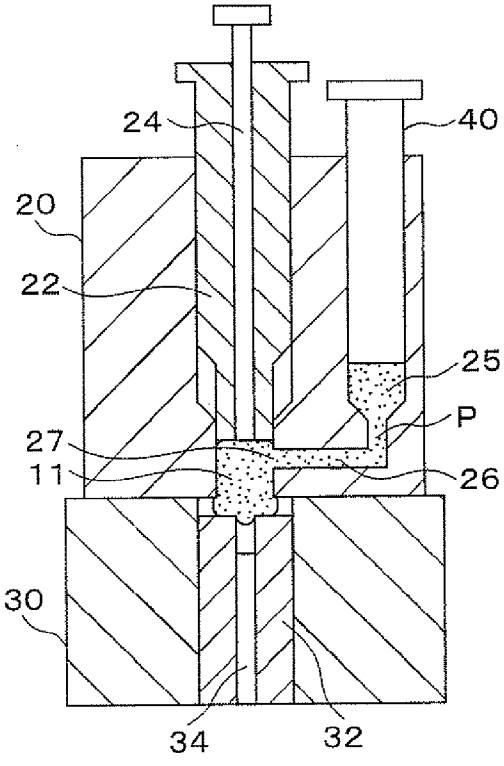
Figure 2C:
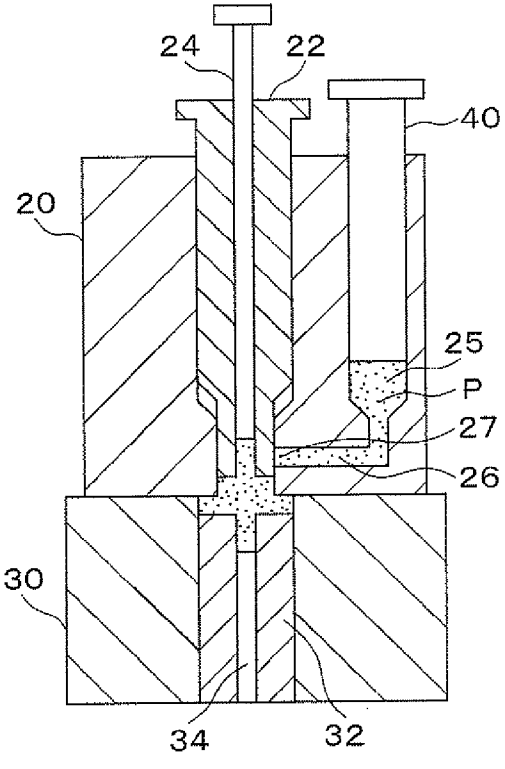

FIGS. 2A to 2C and FIGS. 3A to 3D show a forming step of a green compact of the gear 1 using a forming die assembly of an embodiment. First, the structure of the forming die assembly will be described with reference to FIGS. 2A to 2C. As shown in FIGS. 2A to 2C, a reference numeral 10 denotes a forming die, and the forming die 10 is formed of an upper die 20 and a lower die 30. The upper die 20 and the lower die 30 are vertically movably provided and are arranged so that they can relatively vertically make contact with each other and separate from each other.

The upper die 20 is formed with an outer upper punch hole 21 that vertically penetrates through the upper die 20. The outer upper punch hole 21 is formed so that an outer upper punch 22 is slidably inserted thereinto from the opening at the upper side. The outer upper punch 22 has a shaft center through which an inner upper punch hole 23 penetrates. The inner upper punch hole 23 is formed so that a rod-shaped inner upper punch 24 is vertically slidably inserted thereinto.

The outer upper punch hole 21 has a lower end portion, and the lower end portion is reduced in the diameter via a tapered portion 21*a* and is formed with a smaller diameter portion 21*b*. The outer upper punch 22 has a lower end portion, and the lower end portion is reduced in the outer diameter via a tapered portion 22*a*. That is, this lower end portion is formed with a smaller diameter portion 22*b* so as to correspond to the shape of the lower end portion of the outer upper punch hole 21. The smaller diameter portion 22*b* is formed so as to be slidably inserted into the smaller diameter portion 21*b* of the outer upper punch hole 21.

Figure 4:
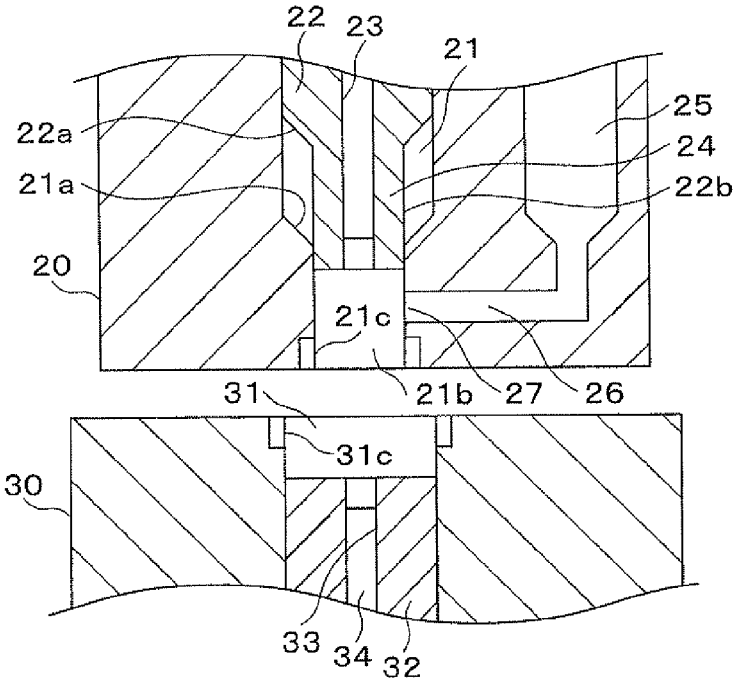
FIG. 4 is a partial cross sectional view of an upper die and a lower die provided to the forming die assembly of an embodiment.

The smaller diameter portion 21*b* of the outer upper punch hole 21 has an inner diameter corresponding to the outer diameter of the spur wheel portion 6 of the gear 1. As shown in FIG. 4, the smaller diameter portion 21*b* has an inner circumferential surface that is formed with internal teeth 21*c* for forming the teeth 2 of the spur wheel portion 6 of the gear 1. The inner upper punch hole 23 of the outer upper punch 22 has an inner diameter that is set so as to be the same as the diameters of the shaft portions 4 and 5 of the gear 1.

The upper die 20 is formed with a storage portion 25 for storing a raw material. The storage portion 25 is arranged in parallel with the outer upper punch hole 21 and is a cylindrical space extending in the vertical direction. The storage portion 25 has an opening at the upper side, and a raw material P having plasticity is filled from the opening and is stored in the storage portion 25. The raw material P may be a powder that is formed by mixing 40 to 60 volume % of a binder with a metal powder and by kneading them. The metal powder may be an iron powder, and the binder may be made of thermoplastic resin and wax.

The upper die 20 has a lower end portion that is formed with a supply path 26. The supply path 26 connects the lower end portion of the storage portion 25 and the space within the smaller diameter portion 21*b* of the outer upper punch hole 21 and horizontally extends. As shown in FIG. 2B, the space within the smaller diameter portion 21*b* of the outer upper punch hole 21 is used as a cavity 11 when the outer upper punch 22 and the inner upper punch 24 are raised to the upper end portion of the smaller diameter portion 21*b*. That is, the supply path 26 is formed so as to be connectable to the cavity 11 and has an opening to the cavity 11. The opening is used as a gate 27. As shown in FIG. 2A, the gate 27 is closed by the lower end portion of the outer upper punch 22 when the outer upper punch 22 is pressed down. On the other hand, as shown in FIG. 2B, the gate 27 is opened when the outer upper punch 22 is raised.

The storage portion 25 is formed so that a plunger 40 is slidably inserted thereinto from the opening at the upper side. When the plunger 40 is pressed down in a condition in which the gate 27 is opened, the raw material P in the storage portion 25 flows through the supply path 26 and is filled from the gate 27 into the cavity 11.

The lower die 30 is formed with a cylindrical hole 31 that vertically extends and penetrates through the lower die 30, and the cylindrical hole 31 is coaxial with the outer upper punch hole 21 of the upper die 20. The cylindrical hole 31 has an inner circumferential surface with a shape corresponding to the shape of the teeth 2 of the spur wheel portion 3 of the gear 1. Alternately, as shown in FIG. 4, the cylindrical hole 31 may have an upper end portion having an inner circumferential surface that is formed with internal teeth 31*c*. The internal teeth 31*c* are used for forming the teeth 2 of the spur wheel portion 3. The cylindrical hole 31 is formed so that an inner die 32 is vertically slidably inserted thereinto. The inner die 32 has a shaft center that is formed with a lower punch hole 33, and the lower punch hole 33 extends in the vertical direction. The lower punch hole 33 is coaxial with the inner upper punch hole 23 and has the same inner diameter as that of the inner upper punch hole 23. The lower punch hole 33 is formed so that a rod-shaped lower punch 34 is slidably inserted thereinto.

(2-2) Forming Step

A forming step for a green compact of the gear 1 using the forming die assembly of the above embodiment will be described with reference to FIGS. 2A to 2C and FIGS. 3A to 3D. First, the outer upper punch 22 is inserted into the upper die 20 so that the internal teeth 21*c* at the lower end portion of the smaller diameter portion 21*b* of the outer upper punch hole 21 are exposed. As a result, the gate 27 is closed by the outer upper punch 22. The inner upper punch 24 is raised, whereby the lower surface of the inner upper punch 24 is positioned higher than the lower end surface of the outer upper punch 22. On the other hand, the inner die 32 at the side of the lower die 30 is positioned lower than the lower die 30 so as to expose the internal teeth 31*c* at the upper end portion of the cylindrical hole 31. Moreover, the lower punch 34 is lowered more than the inner die 32. In this condition, the lower surface of the upper die 20 and the upper surface of the lower die 30 are brought into contact and are clamped (FIG. 2A). Thus, a cavity 11 is formed in the forming die 10. The cavity 11 has a portion corresponding to the spur wheel portion 6 and the shaft portion 4 of the gear 1 at the side of the upper die 20. The cavity 11 also has a portion corresponding to the spur wheel portion 3 and the shaft portion 5 of the gear 1 at the side of the lower die 30.

Next, the outer upper punch 22 is raised so that the upper end portion of the smaller diameter portion 21*b* of the outer upper punch 21 is connected to the cavity 11 and the gate 27 is opened. The plunger 40 is pressed down, whereby a necessary amount of the raw material P in the storage portion 25 is filled from the supply path 26 through the gate 27 to the cavity 11 (FIG. 2B).

Then, the inner upper punch 24, the inner die 32, and the lower punch 34 are secured, and the outer upper punch 22 is pressed down so as to close the gate 27 and to form the shape of the cavity into the shape of the gear 1. The outer upper punch 22 is further pressed down so as to compact the raw material P in the cavity 11 (FIG. 2C). Thus, the spur wheel portion 6 and the shaft portion 4 are formed at the side of the upper die 20, and the spur wheel portion 3 and the shaft portion 5 are formed at the side of the lower die 30. Accordingly, a green compact 1A of the gear 1 is formed.

Figures 3A, 3B, 3C, 3D:
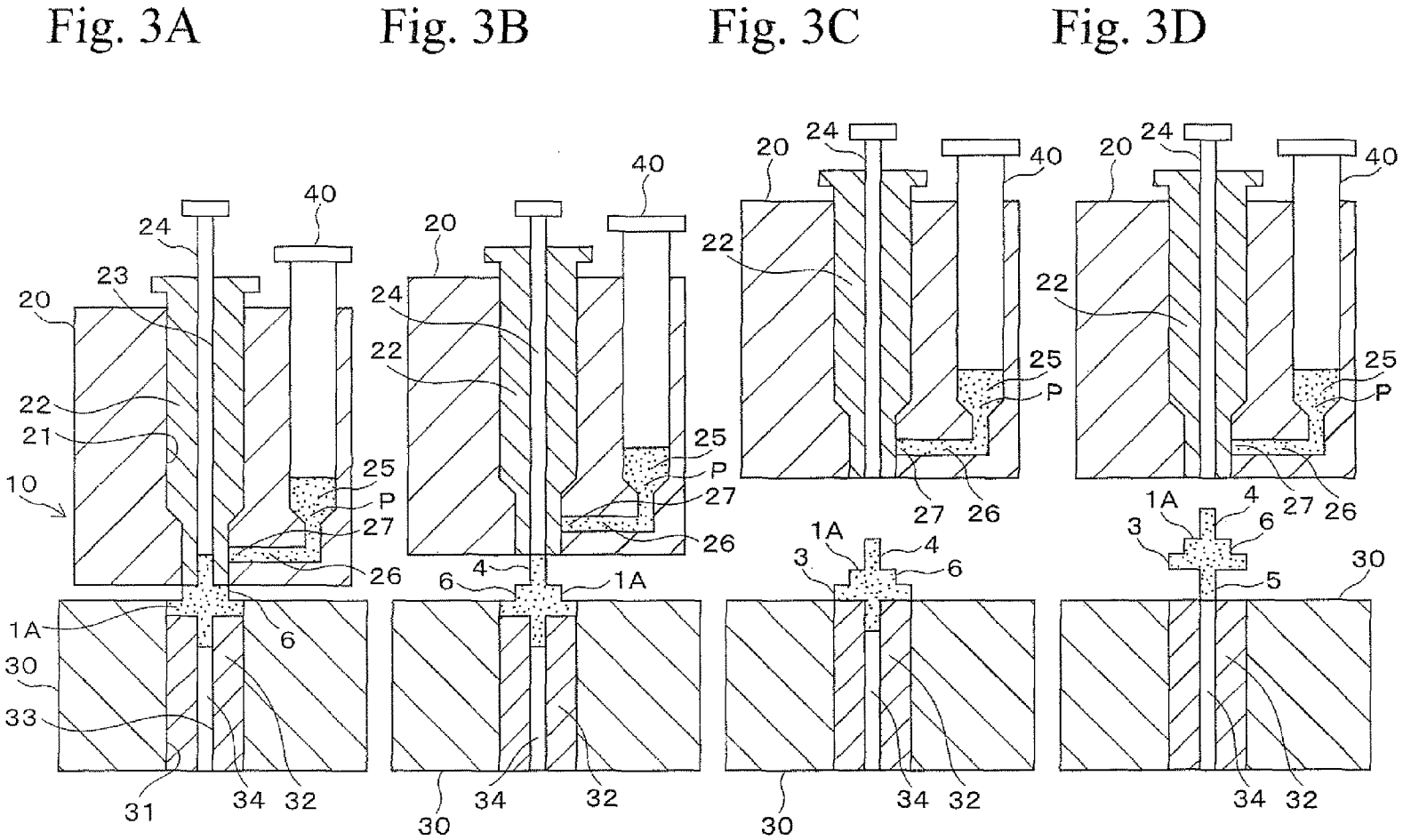
FIGS. 3A to 3D are cross sectional views showing the rest of the forming step.

After the green compact 1A is formed, the forming die 10 is opened so as to pull out the green compact 1A. In this case, the upper die 20 is raised so as to expose the spur wheel portion 6 (FIG. 3A). Then, while the inner upper punch 24 holds down the green compact 1A, the outer upper punch 22 and the upper die 20 are raised, whereby the shaft portion 4 is exposed (FIG. 3B). After the entire of the structural components at the side of the upper die 20 is raised, the inner die 32 is raised so as to pull out the spur wheel portion 3 (FIG. 3C). The lower punch 34 is raised, and the shaft portion 5 is upwardly pulled out from the lower punch hole 33 (FIG. 3D). As described above, one green compact 1A is formed by the operation. After the green compact 1A is removed from the forming die assembly, the condition of the forming die assembly is returned to the condition shown in FIG. 2A. Then, by repeating the above operation, plural green compacts 1A are obtained.

(2-3) Effects

According to the forming die assembly of the above embodiment, the outer upper punch 22 is raised so as to open the gate 27, and the raw material P stored in the storage portion 25 in the upper die 20 is filled in the cavity 11 by pressing down the plunger 40. Next, the outer upper punch 22 is pressed down so as to close the gate 27 and to compress the raw material P in the cavity 11. Then, the forming die assembly is opened, whereby a green compact 1A is obtained. By repeating this operation, green compacts 1A are successively obtained.

In this embodiment, a small amount of the raw material P is easily filled in the cavity 11 by pressing down the plunger 40 without pulling out the outer upper punch 22 and the inner upper punch 24 from the upper die 20. Accordingly, even when the amount of the raw material P is small in one forming, the green compact 1A is efficiently produced. The inner upper punch 24 has a leading end portion which receives high pressure in compacting, and the leading end portion is formed so as to be contained in the outer upper punch 22 at any time. Accordingly, even when the inner upper punch 24 is extremely thin, damages, such as bending and folding, to the inner upper punch 24 are prevented.

(3) Another Example of the Forming Die Assembly

Figure 5:
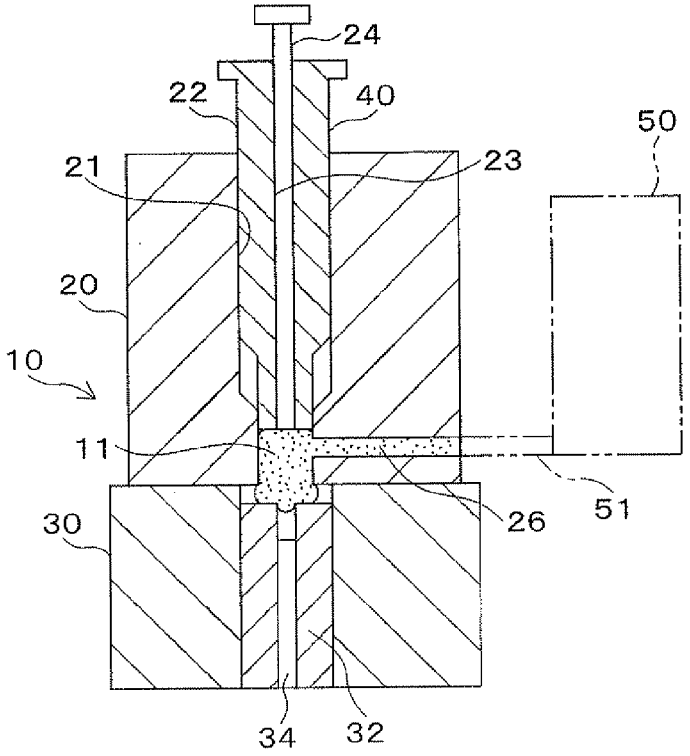
FIG. 5 is a cross sectional view showing another example of a forming die assembly of an embodiment.

FIG. 5 shows another example of the forming die assembly of the above embodiment. In this case, the storage portion 25 is not provided to the upper die 20, and a tank 50 for storing the raw material P is separately arranged to the outside as the storage portion. The tank 50 is connected to the supply path 26 via a pipe 51 and is structured so that the raw material P in the tank 50 flows from the pipe 51 into the supply path 26. In this case, the tank 50 is formed so as to be vertically movable in conjunction with the upper die 20, or the pipe 51 is formed so as to be flexible in order to follow the vertical movement of the upper die 20.

In this example, it is not required to form the storage portion 25 in the upper die 20 as is the case in the above embodiment. In addition, the raw material P can be supplied to the tank 50 while the forming die assembly is operated. In other words, in the above embodiment in which the storage portion 25 is uniformly provided to the upper die 20, it is not required to separately arrange a storage portion of the tank 50 and to connect it to the supply path 26. Accordingly, the forming die assembly is separately operated, and the supply route of the raw material P is simple.

(4) Variations of the Present Invention

In the above embodiments, a gear is formed as a microcomponent, which has shaft portions at both sides of a spur wheel portion. In addition to the microcomponent having the shaft portions at both sides of the spur wheel portion, a microcomponent having the shaft portion at one side of the spur wheel portion may be formed. Alternately, a microcomponent having only the spur wheel portion may be formed. On the other hand, a microcomponent may be formed so as to have shaft portions at both sides of a simple disc-shaped flange portion instead of the spur wheel portion. In this case, a microcomponent may be formed so as to have a shaft portion at one side of the flange portion. Moreover, a microcomponent in a simple disc shape may be formed.

Furthermore, the upper die 20 is preferably provided with a heating means for heating the raw material P that passes through the supply path 26. By heating the raw material P with this heating means, the flowability of the raw material P is increased, and filling of the raw material P into the cavity 11 is smoothly and sufficiently performed. In this case, the heating temperature is set to be approximately the softening point of the thermoplastic resin added to the binder of the raw material P. It should be noted that the heating means may be provided at both the upper die 20 and at the lower die 30 to heat the cavity 11.

What is claimed is:

1. A forming die assembly for microcomponents, comprising:

a forming die formed with a cavity, an outer punch hole including a small diameter hole connected to the cavity and a large diameter hole axially extending from the small diameter hole and having larger diameter than that of the small diameter hole, and a supply path for supplying a raw material with a metal powder and a binder having plasticity, the supply path being connected to the cavity so as to have a gate therebetween and being used for supplying the raw material into the cavity; and a punch configured to open and close the gate by reciprocatory sliding, and further configured to close the gate and compress the raw material in the cavity into a green compact by sliding in the direction of the cavity, wherein:

the green compact has a flange portion and a shaft portion that projects from the flange portion, and the punch comprises:

an outer punch that is slidably inserted into the outer punch hole and forms an end surface of the flange portion, the outer punch having an inner punch hole, and an inner punch that is slidably inserted into the inner punch hole and forms an end surface of the shaft portion, wherein the outer punch comprises a small diameter portion in the vicinity of the end surface of the flange portion and a large diameter portion that axially extends from the small diameter portion and has a larger diameter than that of the small diameter portion, and the small diameter portion is closely fitted into the small diameter hole in a sliding condition and the large diameter portion is closely fitted into the large diameter hole in a sliding condition, and wherein the forming die is provided with a storage portion which is connected to the supply path and is used for storing the raw material, the storage portion being formed so that a plunger may be slidably inserted thereinto thereby supplying the raw material stored in the storage portion via the gate into the cavity.

2. The forming die assembly for microcomponents according to claim 1, wherein:

the forming die is provided with an upper die and a lower die which are arranged so that they can relatively vertically make contact with each other and separate from each other, the outer punch hole and the supply path are formed at one of the upper die and the lower die, and the cavity is formed when the upper die and the lower die are brought into contact with each other.

* * * * *